US010179672B2

(12) United States Patent
Kuhls et al.

(10) Patent No.: US 10,179,672 B2
(45) Date of Patent: Jan. 15, 2019

(54) CONTAINER ASSEMBLY

(71) Applicant: TTS Tooltechnic Systems AG & Co. KG

(72) Inventors: Timo Kuhls, Stuttgart (DE); Lutz Wolle, Burlafingen (DE)

(73) Assignee: TTS Tooltechnic Systems AG & Co. KG, Wendlingen (DE)

( * ) Notice: Subject to any disclaimer, the term of this patent is extended or adjusted under 35 U.S.C. 154(b) by 328 days.

(21) Appl. No.: 14/898,811

(22) PCT Filed: Jul. 5, 2013

(86) PCT No.: PCT/EP2013/001997

§ 371 (c)(1),
(2) Date: Dec. 16, 2015

(87) PCT Pub. No.: WO2015/000497

PCT Pub. Date: Jan. 8, 2015

(65) Prior Publication Data

US 2016/0130034 A1 May 12, 2016

(51) Int. Cl.
*B65D 21/02* (2006.01)
*B25H 3/02* (2006.01)

(52) U.S. Cl.
CPC ..... *B65D 21/023* (2013.01); *B25H 3/023* (2013.01)

(58) Field of Classification Search
CPC ..... B65D 71/0003; B65D 21/0212; B65D 21/023; H05K 5/0021; B25H 3/023
USPC ..... 206/509, 510
See application file for complete search history.

(56) References Cited

U.S. PATENT DOCUMENTS 1,345,247 A 6/1920 Robbins
2,361,079 A * 10/1944 Berry ..... B25H 3/023 312/244
4,643,494 A * 2/1987 Marleau ..... A45C 5/00 292/120
5,415,277 A * 5/1995 Berntsen ..... B65D 21/0212 206/144
5,540,329 A * 7/1996 Vogeley ..... B25H 3/00 206/373

(Continued)

FOREIGN PATENT DOCUMENTS

EP 0555533 8/1994
EP 0753383 1/1997
EP 0721893 3/1999

(Continued)

*Primary Examiner* — Jeffrey Allen
(74) *Attorney, Agent, or Firm* — Hoffmann & Baron, LLP

(57) ABSTRACT

A container assembly includes at least one container that can be stacked, which has a base unit having a main accommodating body and having a carrying handle and which also has two auxiliary accommodating bodies, which sit on the main accommodating body and cover a main accommodating chamber formed therein in a basic position. Each auxiliary accommodating body has an auxiliary accommodating chamber that can be closed by means of a pivotable closing cover. The auxiliary accommodating bodies can be moved into an access position, in which the auxiliary accommodating bodies make the main accommodating chamber accessible. In addition, couplers are arranged on the base unit wherein the couplers enable vertical coupling of a plurality of stacked containers.

24 Claims, 6 Drawing Sheets

(56) References Cited

U.S. PATENT DOCUMENTS

| | | | | |
|---|---|---|---|---|
| 5,577,613 | A * | 11/1996 | Laidlaw | G06F 1/181<br>206/509 |
| 2012/0024739 | A1 * | 2/2012 | Fjelland | B65D 21/023<br>206/503 |

FOREIGN PATENT DOCUMENTS

| | | |
|---|---|---|
| EP | 2289671 | 3/2011 |
| EP | 2315701 | 2/2012 |
| EP | 2551210 | 1/2013 |

* cited by examiner

CONTAINER ASSEMBLY

This application claims priority based on an International Application filed under the Patent Cooperation Treaty, PCT/EP2013/001997, filed Jul. 5, 2013.

BACKGROUND OF THE INVENTION

The invention relates to a container assembly, comprising at least one stackable container, which has a base unit with a main accommodating body, the main accommodating body defining a main accommodating chamber, which is accessible at its top via a main opening and which is bounded by a bottom and a continuous side wall projecting upwards from the edge of the bottom in a vertical direction of the container, wherein the container has a carrying handle on the main accommodating body in the region of its top side, and wherein coupling means suitable for the releasable coupling of at least two containers stacked in the vertical direction to form a stacked composite preventing a mutual lift-off in the vertical direction are provided on the base unit.

A container assembly of this type, which is known from EP 2 551 210 A1, comprises, among other aspects, a plurality of stackable containers of the same type, each having a base unit consisting of a main accommodating body open at the top and an upward-projecting carrying handle located on the main accommodating body. The top opening of the main accommodating body, which can be described as main opening, allows objects, for example tools, to be put in and taken out as required. As each container is equipped with suitable coupling means, it is possible to stack several containers on top of one another in the vertical direction and to combine them to form a cohesive stacked composite which is easily transported by gripping the carrying handle of the topmost container.

In the container known from EP 2 551 210 A1, the content of the main accommodating body is always accessible through the main opening. This makes for easy handling. On the other hand, the content of the main accommodating body can easily be contaminated through the ever open main opening. In addition, the container is less suitable for storing small parts, because these can fall out through the ever open main opening and eventually get lost.

From EP 2 315 701 B1 and EP 0 555 533 B1, stacking container assemblies are known which comprise a plurality of containers which can be stacked on top of one another and coupled to one another, each of them consisting of a base part and a cover, so that an opening providing access to an interior of the container can be closed if required.

EP 0 721 893 B1 discloses a container the interior of which can be closed by a cover and which is fitted with an insert system comprising a plurality of small containers, which facilitates a space-saving use of the interior of the container for the storage of products.

From U.S. Pat. No. 1,345,247 a combination of a toolbox and a sawhorse is known, wherein the toolbox has elements which can be swung out and allow the toolbox to be converted into a sawhorse.

SUMMARY OF THE INVENTION

The invention is based on the problem of creating a container assembly comprising at least one container which can be stacked and coupled vertically and the interior of which is suitable for a tidily arranged storage and protected accommodation of objects.

In combination with the features referred to above, this problem is solved by providing that the container comprises two auxiliary accommodating bodies, which in a retracted home position are placed adjacent to one another on the main accommodating body while covering the main opening, and each of which defines an auxiliary accommodating chamber, which is accessible at its top via an auxiliary opening and which is bounded by a bottom and a continuous side wall projecting upwards from the edge of the bottom in a vertical direction of the container, wherein each auxiliary accommodating body can be moved relative to the main accommodating body, while maintaining its spatial orientation adopted relative to the main accommodating body owing to bearing means provided, and while performing a transitional movement, into an extended access position, which at least partially uncovers the main opening for access to the main accommodating chamber while laterally projecting beyond the main accommodating body, and wherein a closing cover movable between a closed position covering the associated auxiliary opening and at least one release position uncovering the auxiliary opening is provided on each auxiliary accommodating body, wherein, in the stacked and coupled state of several containers, the auxiliary accommodating bodies of a respective lower container, which adopt the home position, are, together with their closing covers adopting the closed position, placed between the main accommodating bodies of the containers located directly on top of one another.

The stackable container designed in accordance with the invention offers to the user a plurality of accommodating chambers for the separate and, if required, sorted storage of objects. All accommodating chambers defined by the various accommodating bodies can be brought into a state in which they are closed against the environment. The main opening of the main accommodating chamber is closed by the auxiliary accommodating bodies in their retracted home position, while the auxiliary accommodating chambers formed in the auxiliary accommodating bodies can be closed if not in use by the movable and in particular pivotable closing covers. In this way, the products stored inside are protected against contamination and cannot fall out, so that the at least one stackable container is particularly suitable for the storage of small parts, for example tools such as drills or ironmongery such as screws or nails. The main accommodating chamber will preferably be used to store larger objects such as hand tools, while the auxiliary accommodating chambers are primarily suitable for storing the small parts mentioned above. If required, each accommodating chamber can be divided into individual compartments. It is furthermore possible to releasably install additional small containers in one or more accommodating chambers for the sorted storage of small parts. All accommodating chambers are easily accessible if required, because the auxiliary accommodating bodies can be moved within a transitional movement between the retracted base position covering the main opening and an extended access position in which they project at least partially beyond the main accommodating body in the lateral direction. The assembly is in particular configured such that the auxiliary accommodating bodies completely open up the main opening of the main accommodating chamber in the access position. It is preferable if the auxiliary accommodating bodies can optionally be placed independently in the home position or in the access position.

The coupling means on the base unit enable the stackable container to be stacked vertically with one or more identical containers despite the movable auxiliary accommodating bodies and to be coupled to form a coherent stacked composite which is easily transported by gripping the carrying handle of the topmost container. Depending on the configuration of the at least one container, it can be ensured that the auxiliary accommodating bodies and closing covers of the container placed below a top container are, merely by the stacking of several containers and/or preferably by special locking means, located in such a way that they are not inadvertently extended into the access position or moved into the release position while the stacked composite is being transported. It is particularly advantageous if the stackable container is provided with locking means for the releasable locking of the closing covers in their closed position and—in particular indirectly as a result of this locking action—for blocking the auxiliary accommodating bodies in their home position, in particular if only one stackable container is used and preferably also if a vertically coherent stacked composite has been produced by coupling.

Advantageous further developments of the invention can be derived from the dependent claims.

The container assembly expediently comprises a plurality of stackable containers of the type described above, which can both be used individually and stacked on top of one another in the vertical direction and releasably coupled in pairs using the coupling means provided to form a stacked composite within which the coupled containers are joined to one another without being pulled apart in the vertical direction, preventing a mutual lift-off. These several stackable containers are expediently identical in design.

The auxiliary accommodating bodies are expediently arranged adjacent to one another at right angles to a longitudinal axis of the associated container, having a minimum distance from one another in the home position and a larger distance in the extended access position of the two auxiliary accommodating bodies. The auxiliary accommodating bodies are preferably oblong and arranged along one another.

The bearing means facilitating the guided transitional movement are in particular configured as pivot bearing means in such a way that the transitional movement is at least partially and preferably entirely a pivoting movement in which the respective auxiliary accommodating body is pivoted while maintaining its spatial orientation relative to the main accommodating body. In this way, the auxiliary accommodating body can, for example, not be tilted in the pivoting process, which could result in stored objects falling out. This is ensured in the execution of all transitional movements by the constantly maintained spatial alignment between the auxiliary accommodating bodies and the main accommodating body.

The pivot bearing means are in particular designed such that the transitional movement follows an arc-shaped path. It is expedient if each auxiliary accommodating body changes its vertical position in its transitional movement, wherein it passes through its highest point in particular and wherein it is expedient if the vertical position adopted by the auxiliary accommodating body relative to the main accommodating body is the same in the home position as in the access position.

Particularly expedient is an implementation of the pivot bearing means as a parallelogram mounting by means of a plurality of articulated parallelograms. Each auxiliary accommodating body is preferably pivotably mounted by means of two pairs of guide arms which are pivotably mounted in the auxiliary accommodating body on the one hand and on the base part on the other hand.

It is advantageous if the guide arms project into bearing chambers of the main accommodating body and the auxiliary accommodating body, which are formed by double-walled sections of the side walls, and are bearing-mounted therein in such a way that they are covered towards the outside towards the surroundings of the container in the home position of the auxiliary accommodating bodies. In this way, damage to or contamination of the pivot bearing means is avoided. It is further advantageous if the guide arms are bulkheaded towards the main accommodating chamber and the associated auxiliary accommodating chamber, so that their pivoting movement cannot be impeded by objects placed in the respective accommodating chamber.

The coupling means for the vertically coherent coupling of several containers are expediently arranged in the region of end faces of the base unit which are opposite one another in the axial direction of a longitudinal axis of the container. In this way, the auxiliary accommodating bodies can perform their transitional movement without impediment. It is advantageous if, exclusively in the region of these two axial end faces, coupling means are provided for the vertical coupling of several containers. The coupling means are expediently located directly on the main accommodating body.

A particularly expedient variant of the coupling means provides that at least one and preferably precisely one coupling unit is provided in the region of each of the two axial end faces, the coupling unit consisting of a lower coupling element located near the bottom of the main accommodating body and an upper coupling element located at a higher level. At least one of the coupling elements is movable for establishing or releasing a coupling engagement of a container placed above or below. Stacked containers can in particular be releasably coupled by means of an upper coupling element of the bottom container and a lower coupling element of the top container. In each case, the upper coupling element is preferably movable for establishing and releasing a coupling.

The coupling units are expediently located on each axial end face of the base unit in the middle of its width, which offers the advantage that they are placed in the region between the two auxiliary accommodating bodies.

Particularly advantageous is a variant of the movable coupling element as a coupling tab pivotably mounted on the base unit. The coupling element cooperating with the coupling tab expediently is a single- or multi-part coupling projection which can be encompassed by the coupling tab. The coupling tab is in particular designed such that it can only be pivoted like a flap while being incapable of translational movement.

The upper coupling elements of the coupling means are expediently placed at the level of the top the auxiliary accommodating bodies adopting the home position. This is where the closing covers are placed in their closed position.

As a result, the distance to be bridged by the components of two containers to be coupled can be kept to a minimum. In this context, it is particularly advantageous if the upper coupling elements are located on support columns of the base unit, which project upwards beyond the side wall of the main accommodating body and which expediently extend upwards between the auxiliary accommodating bodies in the home position of the auxiliary accommodating bodies. The support columns are preferably joined to the main accommodating body in one piece.

The support columns can be a part of a rigid structure formed in the carrying handle. Alternatively, they can be a part of a partition which extends in the longitudinal direction of the base part and divides the main accommodating chamber into two sub-chambers placed alongside each other.

The partition can be hollow and open towards the underside of the bottom, so that, when two containers are stacked, the upward-projecting carrying handle of the bottom container can dip from below into the slot-shaped cavity of the partition.

It is advantageous if the base unit is provided with further interfacing means which enable the container to be combined with stackable containers of another type to form a stacked composite. This in particular applies to interfacing means facilitating a coupling to containers of the type disclosed in EP 2 315 701 B1 and EP 0 555 533 B1.

As mentioned above, it is advantageous if the at least one stackable container is provided with locking means for releasably locking the closing covers in their closed position. These locking means are located partly on the base unit and partly on the closing covers, being in particular located on the main accommodating body of the base unit. With the aid of such locking means, the closed closing covers can be locked in the home position of the auxiliary accommodating bodies. The locking means are in particular designed such that they facilitate the simultaneous locking of both closing covers.

Such a configuration of the locking means further offers the advantage that the inward-pivoted home position of the associated auxiliary accommodating body is ensured if the closing covers are locked. As the closing covers are located on the auxiliary accommodating bodies, these cannot perform the transitional movement if the closing covers are locked in their closed position.

Particularly advantageous is a configuration in which the locking means are at least partially designed as an assembly with the coupling means for producing a vertical stacked composite of several containers. In this way, the container assembly can be constructed in a particularly simple and cost-effective way.

The coupling means and the locking means preferably comprise at least one common combined coupling and locking element, which is movable relative to the base unit and which can optionally be positioned in an active position locking the closed closing covers or in an inactive position unlocking the closing covers. This common or combined coupling and locking element is designed such that, if adopting its active position in the stacked state of several containers, it is in coupling engagement with a further container in order to couple this further container in the vertical direction positively to the container having the movable coupling and locking element, so that they cannot be pulled apart. The at least one combined coupling and locking element can therefore be used to lock the closed closing covers, irrespective of whether a further container is stacked or not. If a further container is stacked, the combined coupling and locking element can also be used for the mechanical coupling of the stacked containers.

A combined coupling and locking element is expediently assigned to each of the two axial end faces of the base unit. However, the locking function relating to the closing covers is available even if only one of two movable upper coupling elements assigned to the end faces of the base unit is configured as a combined coupling and locking element.

Each closing cover is preferably mounted pivotably on the associated auxiliary accommodating body, in order to be capable of movement between its closed position and its release position within a pivoting movement.

BRIEF DESCRIPTION OF THE DRAWINGS

The invention is explained in greater detail below with reference to the accompanying drawing, of which.

DETAILED DESCRIPTION OF THE PREFERRED EMBODIMENTS

Figure 1:
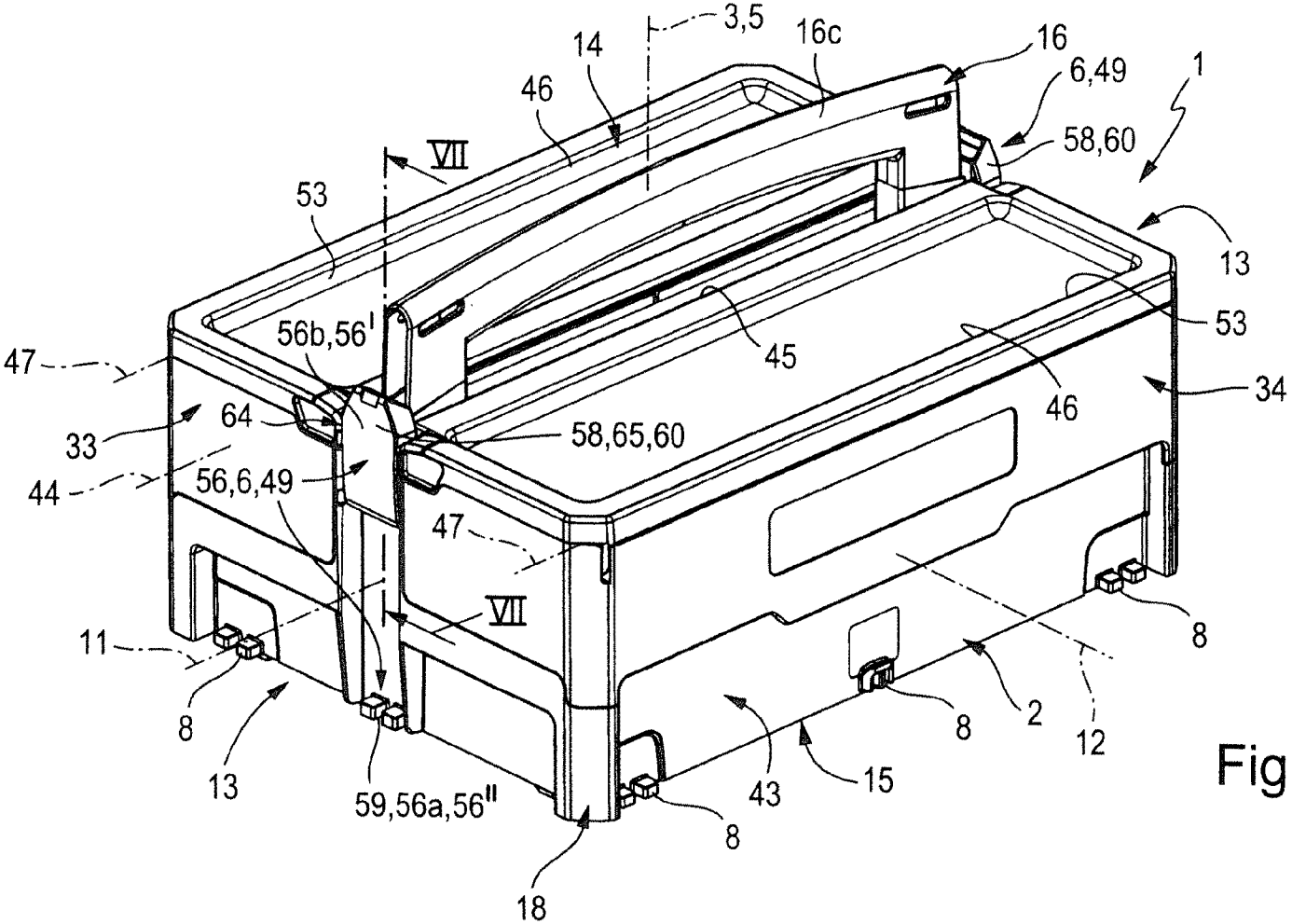
FIG. 1 is a perspective view of a stackable container having an advantageous structure of the container assembly according to the invention, the auxiliary accommodating bodies being in their home position and the closing covers adopting a locked closed position.

The drawing shows an advantageous embodiment of the container assembly 1 according to the invention, which consists of at least one stackable container 2, which is suitable for stacking in a vertical direction 3 indicated by a dot-dash line together with at least one further similar stackable container 2. The container assembly 1 preferably comprises several stackable containers 2 of a similar design, which can be stacked on top of one another—in particular in any preferred sequence—resulting in a container stack 4 as shown by way of example in FIGS. 3 and 5. Such a container stack 4 can, for example, consist of two or more stackable containers 2 placed on top of one another.

Each of the stackable containers 2, which shall only be described only as containers in the following description for simplicity, has a vertical axis 5 extending in the vertical direction 3, the vertical axes 5 of the stacked containers 2 coinciding.

Each container 2 of the container assembly 1 is preferably provided with coupling means 6, which enable two containers 2 of a container stack 4, which are placed directly on top of each other, to be releasably coupled to form a stacked composite 7, within which the stacked containers 2 can be positively joined to one another in the vertical direction 3, so that they cannot be lifted off one another. The coupling means 6 are in particular designed such that a container 2 can be coupled both to another placed on top and to another placed below in the vertical direction 3, in particular by mutual locking. A stacked composite 7 produced by coupling can, if required, simply be taken up and transported by gripping and handling the container 2 placed on top of the stacked composite 7.

Each container 2 can also be used individually. The fact that they are stackable and can be coupled facilitates the storage and transport of a plurality of containers 2.

The container 2 can expediently also be stacked with and coupled to a non-identical further container, i.e. to a container of another type, if the latter is provided with coupling means 6 similar to those of the container 2 described above. The coupling means 6 can preferably also be used to locate the container 2 on its own or as the lowest element of a container stack 4 on a support structure, for example a transport vehicle or a dust extraction device.

In addition to the coupling means 6, the container 2 can be provided with mechanical interfacing means 8, which facilitate its mounting on a stacked container of a different type without any coupling means 6 compatible with the coupling means 6 described above. In the illustrated embodiment, the region of the underside of the container 2, in particular, is provided with a plurality of interfacing means which provide a coupling which cannot be separated in the vertical direction 3 to containers of a type described in EP 0 555 533 B1 and EP 2 315 701 B1. The interfacing means 8 are, for example, designed such that they engage with recesses of a container of another type, or they are represented by at least one locking projection which allows cooperation with a rotary latch of a container of another type.

Each container 2 of the container assembly 1 expediently has a rectangular outline, having an imaginary longitudinal axis 11 perpendicular to the vertical axis 5 and a transverse axis 12 11 perpendicular to the vertical axis 5 and to the longitudinal axis 11. In its longitudinal direction determined by the axial direction of the longitudinal axis 11, the container 2 expediently has a greater overall length than in the transverse direction determined by the axial direction of the transverse axis 12. The two opposite end faces oriented in the longitudinal direction of the container 2 shall be described as axial end faces 13 in the following description for better differentiation.

In the normal position of use of the container assembly 1, the vertical axes 5 are oriented vertically. In addition, each container 2 has in its normal position of use an upward-oriented top side 14 and, opposite thereto, a downward-oriented underside 15. Within a container stack 4 and a stacked composite 7, the top side 14 and the underside 15 of immediately adjacent containers face one another.

Each container 2 has a carrying handle 16 assigned to its top side 14. Using this, each individual container 2 or the topmost container 2 of a stacked composite 7 can be gripped with a hand, lifted up and transported.

A preferred structure of the at least one stackable container 2 of the container assembly 1 is described in greater detail below.

Accordingly, the container 2 comprises a base unit 17 with a main accommodating body 18, which is preferably at least substantially box-like and which defines an interior described as main accommodating chamber 21.

The main accommodating body 18 has a preferably plate-shaped bottom 22 with a rectangular contour and a side wall 23 extending along the edge of the bottom 22 and projecting upwards in the vertical direction 3. The side wall 23 laterally frames the main accommodating chamber 21, which is bounded by the bottom 22 at the bottom. The upward-oriented continuous edge 24 of the side wall 23 bounds an opening of the main accommodating chamber 21, which is described as main opening 25 and through which the interior of the main accommodating chamber 21 is accessible when it is not covered. The main accommodating chamber 21 is suitable for storing objects of any kind, for example hand tools.

The carrying handle 16 mentioned above is a part of the base unit 17 and expediently mounted on the main accommodating body 18. Starting from the main accommodating body 18, the carrying handle 16 preferably projects upwards in the axial direction of the vertical axis 5, therefore projecting above the upper edge 24 of the side wall 23. Although it would, for example, be possible to design the carrying handle 16 as a folding or telescopic handle, it is advantageous if it is joined to the main accommodating body 18 to form a rigid unit.

The carrying handle 16 is preferably designed as a bow handle as in the illustrated embodiment. Two handle legs 16*a*, 16*b*, which are arranged at a distance from each other in the longitudinal direction of the container 2 and which are permanently joined to the main accommodating body 18, extend upwards and are at their upper ends joined to each other by a carrying web 16*c*, which can be gripped by a hand.

The carrying handle 16 expediently extends in a central plane 26 of the base unit 17, which is defined by the longitudinal axis 11 and the vertical axis 5.

Figure 5:
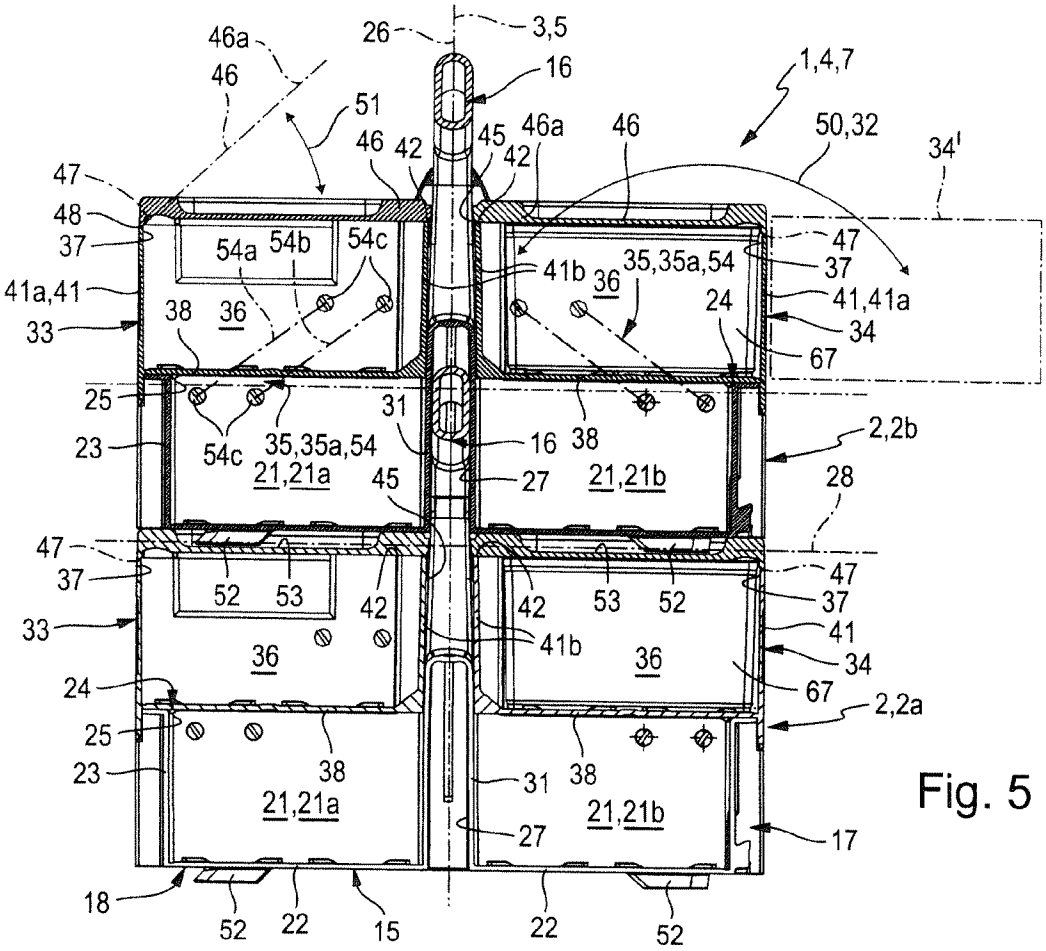
FIG. 5 is a longitudinal section through the container assembly from FIG. 3 along line V-V from FIG. 3.

The carrying handle 16 expediently always projects upwards at the top side 14 relative to the adjacent parts of the container 2. This in particular also applies to the closed state of the container 2 as illustrated in FIG. 1, for example. In order for this not to impede the stacking with a similar container 2, the base unit 17 is, in vertical alignment with the carrying handle 16, i.e. in the central plane 26 in the illustrated embodiment, provided with a slot-shaped cavity 27, which is open towards the underside 15 in the region of the bottom 22. This is wide and long enough for allowing the part of the carrying handle 16 projecting from the top side 14 of the container 2 placed below to dip in from below while the containers 2 are being stacked. The vertical section of FIG. 5 illustrates how the carrying handle 16 of the lower container 2*a* of two stacked containers 2 dips from below into the slot-shaped cavity 27 of the upper container 2*b* of the two stacked containers 2.

The slot-shaped cavity 27 and the carrying handle 16 are expediently matched in their dimensions in such a way that their mutual engagement results in stabilising the position of the stacked containers 2 in a horizontal plane 28 defined by the longitudinal axis 11 and the transverse axis 12.

The slot-shaped cavity 27 is expediently represented by the interior of a hollow partition 31, which extends in the main accommodating chamber 21 between the wall sections 23*a*, 23*b* of the continuous side wall 23 which are assigned to the two axial end faces 13. This partition 31, which expediently projects slightly in the upward direction beyond the continuous edge 24 of the side wall 23, divides the main accommodating chamber 21 into two sub-chambers 21*a*, 21*b* located adjacent to each other in the axial direction of the transverse axis 12.

The two handle legs 16*a*, 16*b* are expediently located on the partition 31, from where they extend upwards. The carrying web 16 extending in the longitudinal direction of the container 2 is arranged at a vertical distance above the partition 31.

The containers 2 further comprise two auxiliary accommodating bodies 33, 34, which are movable relative to the base unit 17 and in particular relative to the main accommodating body 18 while performing a transitional movement 32 indicated by double-headed arrows. In the course of this transitional movement 32, the two auxiliary accommodating bodies 33, 34 can, in particular independently of each other, be transferred between a retracted home position shown in FIGS. 1, 3 and 4 and an extended access position shown in FIG. 2. This mobility is the result of bearing means 35, by way of which each of the auxiliary accommodating bodies 33, 34 is mounted on the base unit 17 and on the main accommodating body 18 in particular. A special feature of these bearing means 35 lies in the fact that they hold the spatial orientation adopted by the auxiliary accommodating bodies 33, 34 relative to the main accommodating body 18 constant during the transitional movement 32, ensuring it in particular both in the home position and in the access position.

This is particularly advantageous because each of the auxiliary accommodating bodies 33, 34 defines an accommodating chamber described as auxiliary accommodating chamber 36, which, in the same way as the main opening 25 of the main accommodating chamber 21, has an upward-oriented opening described as auxiliary opening 37 for better differentiation. This ensures that, irrespective of the current position of an auxiliary accommodating body 33, 34, its auxiliary opening 37 has the same orientation as the main opening 25.

Each auxiliary accommodating body 33, 34 is expediently box-shaped, expediently having a rectangular outline if viewed in the axial direction of the vertical axis 5. At the bottom, it has a bottom 38, along the edge of which extends a continuous upward-projecting side wall 41, its upper edge 42 framing the auxiliary opening 37 mentioned above.

In the retracted home position, the auxiliary accommodating bodies 33, 34 adopt a position in which they sit next to each other on the main accommodating body 18 while covering the main opening 25. They are in particular contoured such that the container 2 has, in the region of the auxiliary accommodating bodies 33, 34 in their retracted home position, the same outline as in the region of the main accommodating body 18. In this way, the side wall 23 of the main accommodating body 18 and the side walls 41 of the two auxiliary accommodating bodies 33, 34 together form the continuous side surface 43 of the container 2. Viewed together, the main accommodating body 18 and the two auxiliary accommodating bodies 33, 34 in their home position form an at least substantially rectangular structure.

Each of the auxiliary accommodating bodies 33, 34 has a longitudinal axis 44, which extends parallel to the longitudinal axis 11. The length of the auxiliary accommodating bodies 33, 34 at least substantially equals that of the main accommodating body 18.

In the illustrated embodiment, each of the auxiliary accommodating bodies 33, 34 covers one of the sub-chambers 21*a*, 21*b* of the main accommodating chamber 21 in the home position. For this purpose, each of the auxiliary accommodating bodies 33, 34 has a width measured in the axial direction of the transverse axis 12 which is equal to half the width of the main accommodating body 18 minus half the width of the structure made up of the carrying handle 16 and the partition 31. As a result, each of the auxiliary accommodating bodies 33, 34 sits, if adopting the hole position, with its underside on the upper edge 24 of the side wall 23 of the main accommodating body 18 and is flanked by the carrying handle 16 and/or by the partition 31 on the inside facing the respective other auxiliary accommodating body 33, 34.

If both auxiliary accommodating bodies 33, 34 are positioned in their home position, there is a slot-like gap 45 between them, through which the carrying handle 16 extends. The gap 45 is open at the top side 14 of the container 2, with the carrying handle 16 protruding upwards, so that it can be gripped for transporting the container 2.

As mentioned above, the carrying handle is preferably mounted rigidly on the main accommodating body 18, so that it protrudes upwards beyond the auxiliary accommodating bodies 33, 34 irrespective of whether the container 2 is used on its own or coupled to form a stacked composite 7.

In an embodiment not shown in the drawing, the carrying handle 16 is displaceably mounted on the main accommodating body 18 and/or telescopic in such a way that it can be pushed into the gap 45 when not in use.

Figure 2:
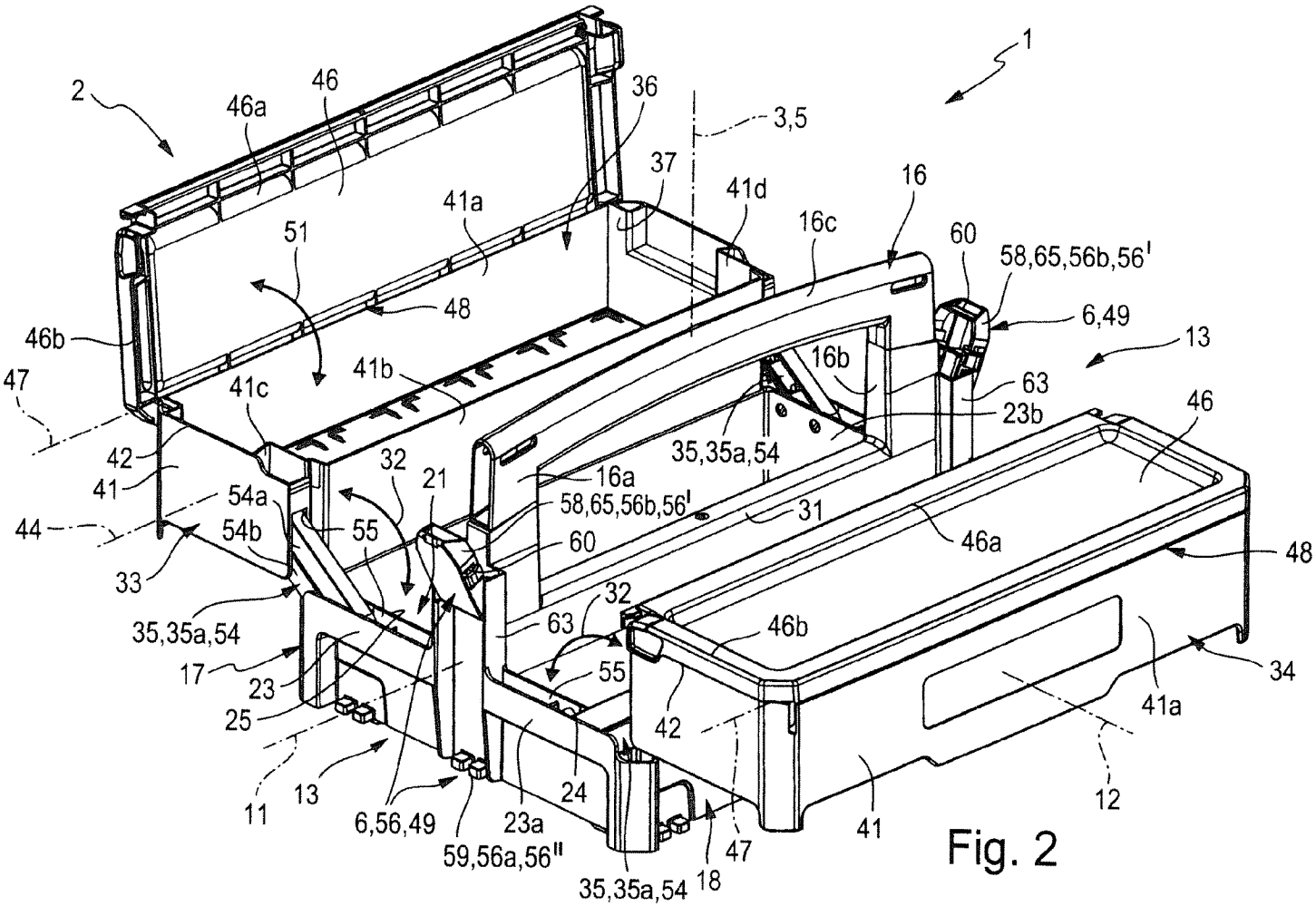
FIG. 2 shows the container from FIG. 1 with the auxiliary accommodating bodies pivoted into access position, the closing cover of one the auxiliary accommodating body being closed while the other is open.

If an auxiliary accommodating body 33, 34 is moved into an access position as shown in FIG. 2, it projects laterally beyond the main accommodating body 18 in the axial direction of the transverse axis 12, simultaneously opening up the region of the main opening 25 it has previously covered, so that the main opening 25 is accessible for depositing or removing an object.

The auxiliary accommodating bodies 33, 34 and the bearing means 35 are in particular designed such that each of the auxiliary accommodating bodies 33, 34 completely uncovers the section of the main opening 25 covered in the home position when adopting its access position. In the illustrated embodiment, this has the result that the auxiliary accommodating body 33, 34 is in its access position situated above the main accommodating body 18 and at the side thereof with at least approximately its complete outline. This is clearly shown in FIG. 5, in which the extended access position of the one auxiliary accommodating body is indicated at 34' by dot-dash lines. In this way, an optimum access to the uncovered main accommodating chamber 21 is ensured.

The bearing means 35 facilitate a mutually independent transitional movement of the two auxiliary accommodating bodies 33, 34. As a result, it is possible to move, while leaving one auxiliary accommodating body 33 in its home position, the other auxiliary accommodating body 34 into the access position.

Each auxiliary accommodating body 33, 34 is provided with a closing cover 46, with which the associated auxiliary opening 37 can optionally be closed or opened. In a closed position, the closing cover 46 extends across the associated auxiliary opening 37 and covers it in such a way that any objects in the auxiliary accommodating chamber 36 cannot fall out. In addition, the closing cover 48 expediently can, while performing a pivoting movement 51 indicated by a double-headed arrow, be pivoted relative to the associated auxiliary accommodating body 33, 34 in such a way that it adopts a release position opening up the auxiliary opening 37, so that objects can be placed in the auxiliary accommodating chamber 36 or removed therefrom. FIG. 2 shows the closed position for the auxiliary accommodating body 34 shown on the right-hand side and a release position of the closing cover 46 for the auxiliary accommodating body 33 shown on the left-hand side.

If required, individual small containers 67 can be installed into the main accommodating chamber 21 and into each auxiliary accommodating chamber 36; in these, small parts in particular can be stored very well. This is shown in FIG. 5.

For opening and closing, the closing cover 46 is pivotably mounted on the associated auxiliary accommodating body 33, 34. The pivot axis 47 indicated by a dot-dash line extends in the longitudinal direction of the container 2. The pivot bearing device 48 facilitating the pivoting movement 51 is in particular designed such that the pivot axis 47 is assigned to the outer longitudinal wall section 41*a* of the side wall 41, which has a greater distance from the carrying handle 16 in the transverse direction of the container. It is in particular located at the upper edge 42.

The closing cover 46 can, for example, be pivotably mounted via a film hinge on a bearing section secured to the outer long-side wall section 41*a*.

As a result of such a mounting system, the long-side inner edge region 46*a* of the closing cover 46, which faces the respective other auxiliary accommodating body 33, 34, is pivoted in the pivoting movement 51. This long-side inner edge region 46*a* of the closing cover 46 rests in the closed position on the edge 42 of that long-side inner wall region 41*b* of the side wall 41 of the auxiliary accommodating body 33, 34 which is adjacent to the carrying handle 16.

In other words, a closing cover 16 is, when the associated auxiliary opening 37 is opened or closed, raised or lowered in its long-side inner edge region 46*a* in order to perform the pivoting movement 51.

Several containers 2 can be stacked if each lower container 2*a* placed below an upper container 2, 2*b* is in a state in which its auxiliary accommodating bodies 33, 34 adopt the home position while the associated closing covers 46 adopt the closed position. In this state, auxiliary accommodating bodies 33, 34 and closing covers 46 of the lower container 2*a* are incorporated between the main accommodating bodies 18 of the two containers 2, 2*a*, 2*b* placed on top of each other. This alone can expediently prevent that an auxiliary accommodating body 33, 34 is inadvertently moved into the access position or a closing cover 46 arrives in a release position. The stored objects can therefore be stored extremely securely.

It is, however, advantageous if the container 2 is additionally provided with special locking means 49, which facilitate, irrespective of whether a container 2 is used individually or placed in a stack, a locking of the closing covers 46 in the locked position and a locking of the auxiliary accommodating bodies 33, 34 in the home position. This will be explained in greater detail below.

The auxiliary accommodating bodies 33, 34 are in particular mounted on the main accommodating body 18 in such a way that they are moved away from each other or towards each other in the axial direction of the transverse axis 12 in the transition between the home position and the access position. This movement can in principle be a linear movement, for example if the auxiliary accommodating bodies 33, 34 are movably mounted on the main accommodating body 18 via guide rails. Much more advantageous, however, is the variant implemented in the illustrated embodiment, in which the bearing means 35 are conceived as pivot bearing means 35*a*, so that the transitional movement 32 is at least partially and preferably entirely a pivoting movement. In either case, it is ensured that the auxiliary accommodating bodies 33, 34 always maintain their adopted spatial orientation relative to the main accommodating body 18. Whatever position an auxiliary accommodating body 33, 34 currently adopts relative to the main accommodating body 18, the auxiliary openings 37 always point in the same direction, which preferably coincides with the orientation of the main opening 25.

The pivot bearing means 35*a* are preferably designed such that each auxiliary accommodating body 33, 34 traverses an arc-shaped path curve 50 in its transitional movement 32; this is indicated in FIG. 5. When traversing this path curve 50, the vertical position of the respective auxiliary accommodating body 33, 34 relative to the main accommodating body 18 changes, so that it at least temporarily adopts a higher position than in the home position. Among other things, this is an aspect which prevents the inadvertent movement of an auxiliary accommodating body 33, 34 in the stacked state of the containers 2, even if no special locking means 49 are provided. The auxiliary accommodating body 33, 34 is blocked by the container 2 placed on top and impeded in its arcuate transitional movement 32.

However, an upper container 2*b* can block auxiliary accommodating bodies 33, 34 placed below even if the transitional movement 32 does not follow a curved path. The only thing required in this case is a suitably matched design of standing feet 52 projecting downwards from the underside of the main accommodating body and engagement recesses 53 formed on top of the outside of the closing covers 46, with which recesses 53 the standing feet 52 engage in the stacked state of the containers 2. In the illustrated embodiment, such standing feet 52 are matched to engagement recesses 53 of the closing covers 46 in such a way that a positive blocking is provided in the horizontal plane 28, whereby the stacked containers are secured against displacement between containers 2 sitting on top of one another an addition to or as an alternative to the carrying handle 16 dipping into the cavity 27.

The pivot bearing means 35*a* are preferably designed such and the auxiliary accommodating bodies 33, 34 are preferably matched in their design to the main accommodating body 18 in such a way that the auxiliary accommodating bodies 33, 34 adopt in the outward-pivoted access position the same vertical position relative to the main accommodating body 18 as in the home position.

The pivot bearing means 35*a* for each of the auxiliary accommodating bodies 33, 34 are preferably implemented by means of a plurality of articulated parallelograms 54. Each of these articulated parallelograms 54 comprises two rigid guide arms 54*a*, 54*b* hinged at the auxiliary accommodating body 33, 34 on the one hand and at the main accommodating body 18 on the other hand, the pivot points 54*c* lying in the corner points of a regular parallelogram.

Each auxiliary accommodating body 33, 34 is preferably assigned its own articulated parallelogram 54 in the region of one of the axial end faces 13 of the container 2. This is the case in the illustrated embodiment. In this context, it is advantageous if the end wall sections 23*a*, 23*b* of the side wall 23 of the main accommodating body 18 as well as the end wall sections 41*c*, 41*d* of the side wall 41 of the auxiliary accommodating bodies 33, 34, which extend in the axial direction of the longitudinal axis 44, are at least partially double-walled and form bearing chambers 55, which are open at the edges and into which the guide arms 54*a*, 54*b* of the articulated parallelograms 54 project. In this way, the articulated parallelograms 54 are, in the home position of the auxiliary accommodating bodies 33, 34, covered against the outside of the container 2 on the one hand and separated or bulkheaded towards the inside both from the main accommodating chamber 21 and from the associated auxiliary accommodating chamber 36 on the other hand. The pivot points 54*c* are preferably located within these bearing chambers 55.

In this way, any damage to the pivot bearing means 35*a* and impediments to or blockages of the pivot bearing means 35*a* caused by objects can be eliminated.

The coupling means 6 mentioned above are located on the base unit 17, so that the base units 17 of the stacked containers within a stacked composite 7 cannot be pulled apart and the bearing means 35 are stress-relieved.

It is further advantageous if the coupling means 6 are, preferably exclusively, located in the region of the two axial end faces 13 of the base unit 17. It is furthermore advantageous if the coupling means 6 are located on the main accommodating body 18.

In the illustrated embodiment, each of the axial end faces of the base unit 17 which are oriented in the axial direction of the longitudinal axis 11 is assigned precisely one coupling unit 56, which is composed of a lower coupling element 56*a* located near the bottom 22 of the main accommodating body 18 and an upper coupling element 56*b* located at a higher level. This single coupling unit 56 is preferably located at the end face of the base unit 17 in the middle of its width relative to the axial direction of the transverse axis 12. In this way, the coupling action occurs in the centre of gravity of the container 2, at minimal production costs and operational effort.

In an embodiment not shown in the drawing, the coupling means 6 comprise a plurality of coupling units 56 per end face of the base unit 17.

While the lower coupling element 56*a* is designed to be stationary relative to the base unit 17 and in particular rigidly mounted on the base unit 17, the upper coupling element 56*b* is movable relative to the base unit 17 and in particular relative to the main accommodating body 18. Although this arrangement can be reversed, the movable design of the upper coupling element 56*b* offers the advantage that it is easily accessible for operation and that it can be used as a part of the locking means 49 mentioned above in a way yet to be described below.

To simplify the description, the movable coupling element represented by the upper coupling element 56*b* in the illustrated embodiment shall also be identified by the reference number 56', while the stationary coupling element shall also be identified by the reference number 56".

The coupling units 56 assigned to the same end face 13 are designed such that, in the vertically stacked state of two containers 2, the upper coupling element 56*b* of the lower container 2*a* can be brought into coupling engagement with the lower coupling element 56*a* of the upper container 2, 2*b*. This coupling engagement is designed such that a positive connection is provided in the vertical direction 3, 5, so that the stacked containers 2*a*, 2*b* cannot be lifted off each other vertically.

Figure 6:
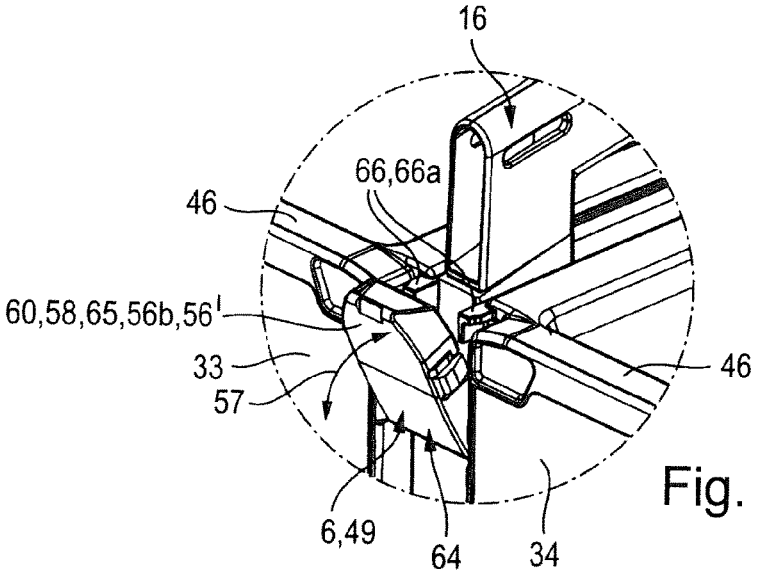
FIG. 6 is an enlargement of the section VI framed by dot-dash lines in FIG. 4, a combined coupling and locking element being shown in an inactive position, the section corresponding to the section VIa framed by dot-dash lines in FIG. 3, in which the combined coupling and locking element is shown in an active position.

The movement which has to be performed by the movable coupling element 56' in order to couple and uncouple the coupling means 6 shall be described as operating movement 57. Within this operating movement 57, the coupling element 56' can optionally be positioned in an active position establishing the coupling engagement—illustrated in FIG. 8—or in an inactive position cancelling the coupling engagement—illustrated in FIG. 6.

The movable coupling element 56' is preferably designed as a coupling tab 58, which is pivotably mounted on the base unit 17, while the stationary coupling element 56" is preferably represented by at least one coupling projection 59 projecting from the base unit 17. The coupling tab 58 has a recess 58*a*, which is bounded by a coupling edge 58*b*, encompassing in the active position the coupling projection 59 in such a way that the latter dips into the recess 58*a* and is encompassed by the coupling edge 58*b* on the side pointing in the vertical direction 3.

The coupling tab 58 is expediently exclusively mounted pivotably on the base unit 17, so that the operating movement 57 is a pure pivoting movement. In principle, the coupling tab 58 could, however, have other degrees of freedom of movement as well. The pivot axis of the coupling tab 58, which is stationary relative to the base unit 17 in the illustrated embodiment, is indicated at 62 in FIGS. 7 and 8; it extends parallel to the transverse axis 12.

Figure 8:
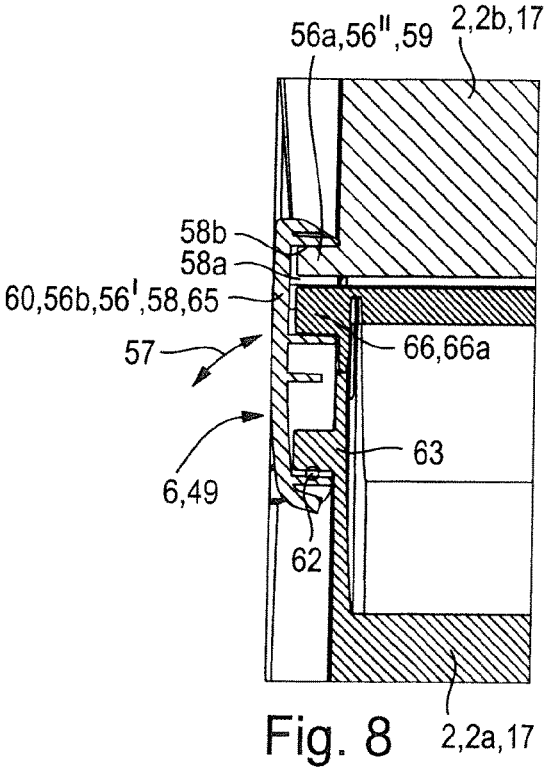
FIG. 8 is a longitudinal section through a section of the container assembly shown in FIG. 3 along line VIII-VIII.

The upper coupling elements 56*b* are expediently placed at the level of the top of the auxiliary accommodating bodies 33, 34 adopting the home position, i.e. at a level also occupied by the closing covers 46 adopting the closed position. This results—as shown in FIG. 8—in a very short connecting path between the coupling units 56 of the stacked containers 2. In addition, this arrangement advantageously facilitates the use of the movable upper coupling element 56*b*, 56' as a component of the locking means 49 for locking the closed position of the closing covers 46.

To enable the upper coupling elements 56*b* to move to the level described above, the base unit 17 is expediently provided in the region of its two axial end faces 13 with a support column 63 each, which projects upwards beyond the side wall 23 and on which the upper coupling element 56*b* is mounted, in particular in its upper end region.

The support columns 63 can be separate from the structure of the carrying handle 16, or they can form a structural unit with the carrying handle 16, as provided in the illustrated embodiment. The support columns 63 can, for example, be permanently joined to a respective adjacent handle leg 16*a* and in particular be integrated therewith.

In the home position of the two auxiliary accommodating bodies 33, 34, the support column 63 is expediently flanked by the two auxiliary accommodating bodies 33, 34, in particular extending upwards between the two auxiliary accommodating bodies 33, 34.

As mentioned above, the at least one stackable container 2 is preferably provided with locking means 49, which facilitate a releasable locking of the closing covers 46 in their closed position when the auxiliary accommodating bodies 33, 34 are in the home position. In this position, the auxiliary accommodating bodies 33, 34 are, preferably indirectly, blocked in their home position as well, and an inadvertent movement into the access position is prevented.

The locking means 49 are on each container 2 located partly on the base unit 17 and partly on the closing covers 46. They are expediently divided into two locking units 64, each of which is located in the region of one of the axial end faces 13 of the container 2. The illustrated embodiment, in which the locking means 49 are at least partially integrated with the coupling means 6, is particularly advantageous, because as a result there is provided, on at least one and expediently on each of the axial end faces 13, a locking unit 64 in addition to a coupling unit 56, the two units having at least one and preferably precisely one component in common. The common component is represented by the movable upper coupling element 56*b*, 56'. This acts as a combined coupling and locking element 65, which is movable relative to the base unit 17 and which can be brought into locking engagement with a mating locking element 66 of each closing cover 46 in the course of the operating movement 57, thereby preventing a pivoting of the respective closing cover 46 into a release position.

The locking position of the combined coupling and locking element 65 is automatically established whenever it is pivoted into the active position mentioned above, which effects in the stacked state of two containers 2 a locking coupling engagement with the base unit 17 of the container 2 placed on top as well.

Figure 3:
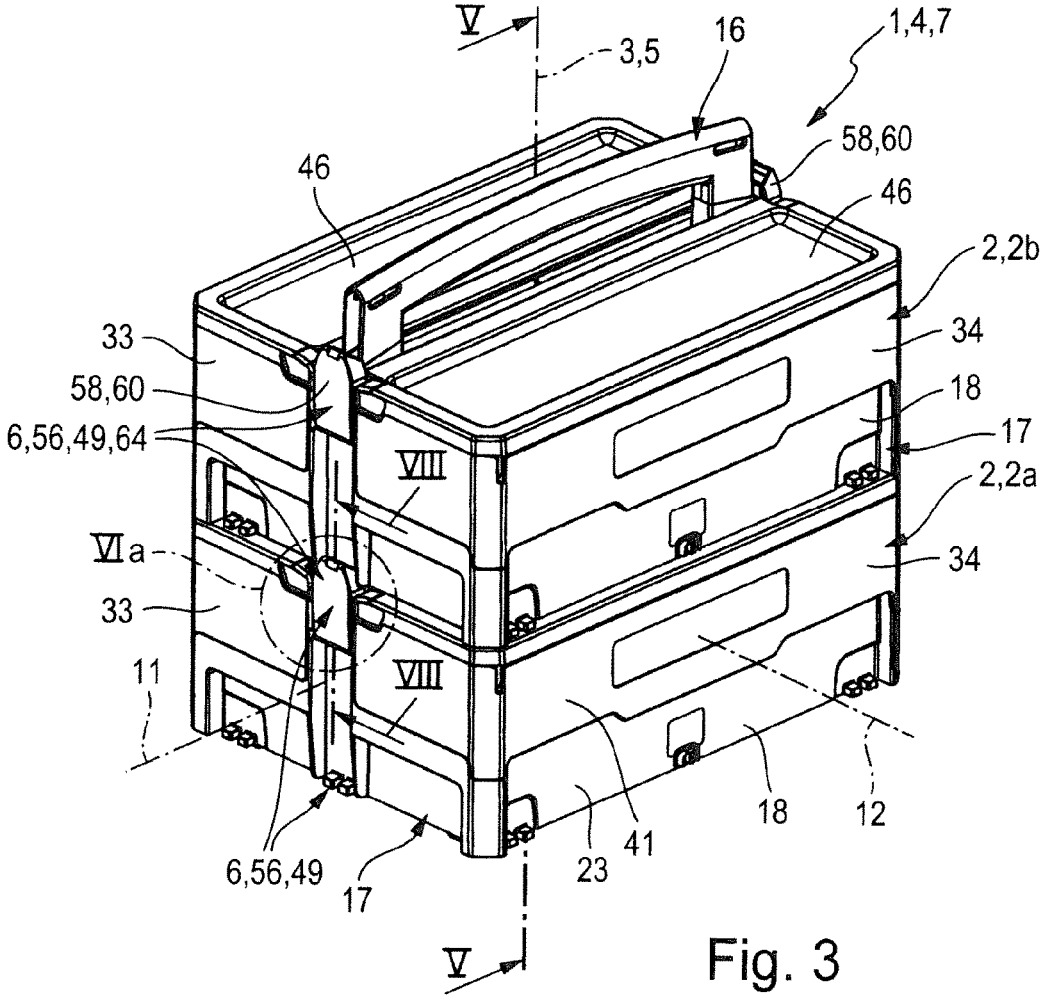
FIG. 3 is a perspective view of a stacked composite consisting of two containers of the type shown in FIGS. 1 and 2, which sit on top of each other in the vertical direction and are coupled to each other in a vertically coherent way.
Figure 4:
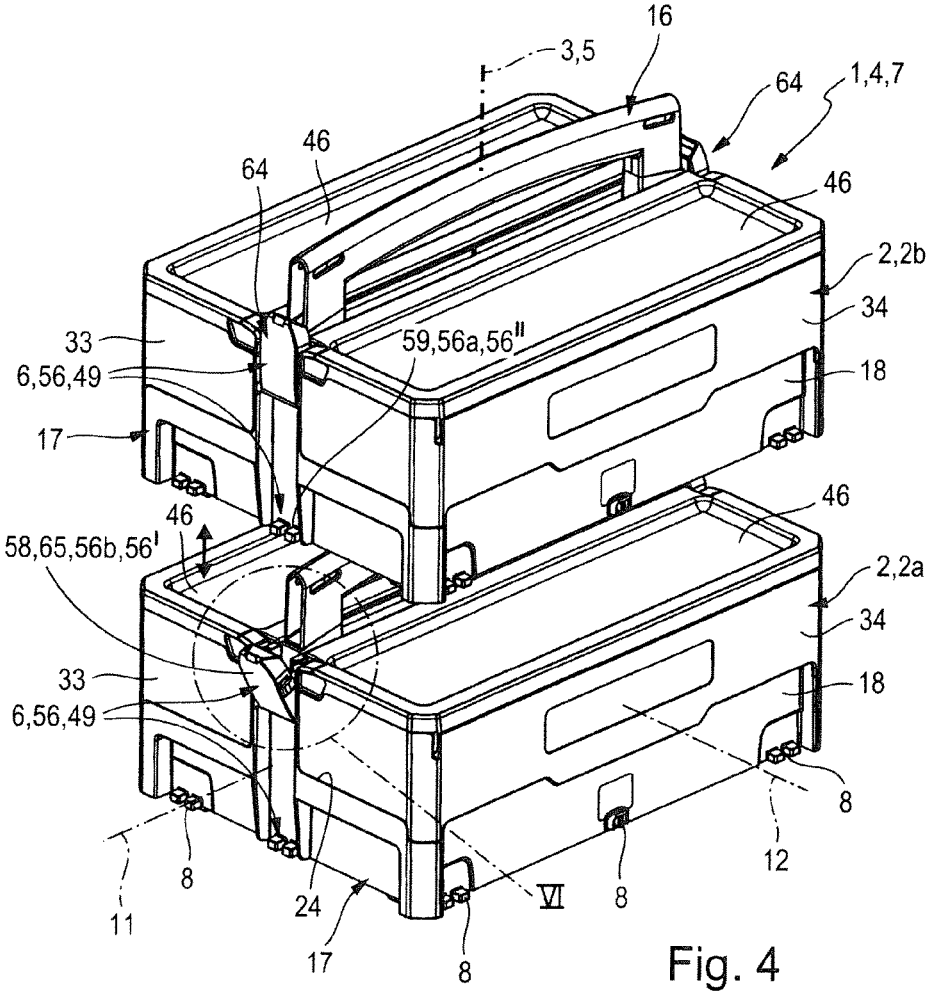
FIG. 4 shows the container assembly from FIG. 3 with the two containers lifted off each other.

If two closed containers are stacked on top of each other, the combined coupling and locking element 65 can, within the operating movement 57, optionally be positioned in an active or an inactive position, locking in the active position the closing covers 46 in the locked position on the one hand and establishing a positive coupling to the upper container 2*b* placed on top on the other hand. This is illustrated in FIGS. 3 and 4, for example.

In the inactive position, both the coupling engagement and the locking engagement are cancelled, so that an upper container 2*b* can be taken off and a lower container 2*a* can be opened. In this context, it is advantageous that, following the uncoupling of the upper container 2, 2*b*, the closing covers 46 and the auxiliary accommodating bodies 33, 34 are automatically unlocked without any further operating step and are ready for use.

Figure 7:
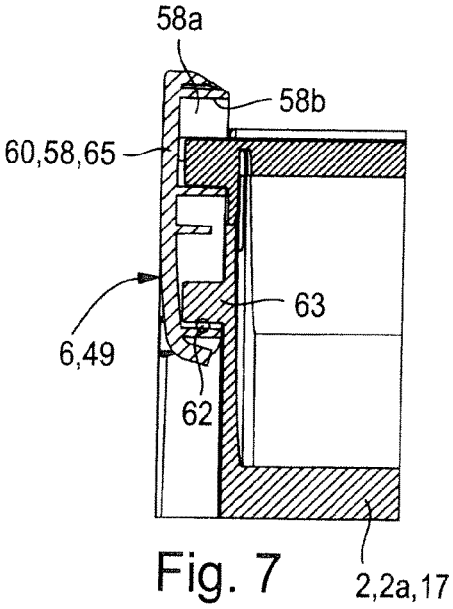
FIG. 7 is a longitudinal section through a section of the container shown in FIG. 1 along line VII-VII.

As far as the operation of the combined coupling and locking element 65 is concerned, it makes no difference whether an upper container 2*b* is present or not. Even in an individual container 2, the active position of the combined coupling and locking element 65 locks the closing covers 46 and indirectly the auxiliary accommodating bodies 33, 34. This is illustrated in FIGS. 1 and 7.

In the combined configuration as coupling and locking element 65, the coupling tab 58 acts as a locking tab 60 as well. In this context, it is advantageous if the mating locking elements 66 are designed as locking projections 66*a*, which in the active position engage with the same recess 58*a* of the coupling tab 58 as a coupling projection 59. It would, however, also be possible to provide separate recesses for the various projections in the coupling tab 58, which acts as locking tab 60 as well.

It is in any case expedient if the locking means 49 are designed such that both closing covers 46 are locked simultaneously in the active position of the coupling and locking element 65. This results in a kind of central locking.

Each closing cover 46 is fitted with the mating locking element 66, expediently in the transitional region between the long-side inner edge region 46*a* and the adjoining end edge region 46*b*. In the locked state, the closing cover 46 can therefore no longer be pivoted up.

The at least one container 2 preferably consists at least mainly of a plastic material. The closing covers 46 can at least partially be made of a transparent material, so that it is possible to see whether a content is in the associated auxiliary accommodating chamber 36 without opening the closing covers 46.

The invention claimed is:

1. A container assembly, comprising at least one stackable container, which has a base unit with a main accommodating body, the main accommodating body defining a main accommodating chamber, which is accessible at its top via a main opening and which is bounded by a bottom and a continuous side wall projecting upwards from an edge of the bottom in a vertical direction of the container, wherein the container has a carrying handle on the main accommodating body in the region of its top side, and wherein coupling means suitable for the releasable coupling of at least two containers stacked in the vertical direction to form a stacked composite preventing a mutual lift-off in the vertical direction are provided on the base unit, wherein the container comprises two auxiliary accommodating bodies, which in a retracted home position are placed adjacent to one another on the main accommodating body while covering the main opening and each of the auxiliary accommodating bodies defines an auxiliary accommodation chamber, which is accessible at its top via an auxiliary opening and which is bounded by a bottom and a continuous side wall projecting upwards from an edge of the bottom in a vertical direction of the container, wherein each auxiliary accommodating body can be moved relative to the main accommodating body, while maintaining its spatial orientation adopted relative to the main accommodating body owing to bearing means provided, and while performing a transitional movement, into an extended access position, which at least partially uncovers the main opening for access to the main accommodating chamber while laterally projecting beyond the main accommodating body, and wherein a closing cover movable between a closed position covering the associated auxiliary opening and at least one release position uncovering the auxiliary opening is provided on each auxiliary accommodating body, wherein, in the stacked and coupled state of several containers, the auxiliary accommodating bodies of a respective lower container, which adopt the home position, are, together with their closing covers adopting the closed position, placed between the main accommodating bodies of the containers located directly on top of one another.

2. A container assembly according to claim 1, comprising a plurality of the stackable containers, which both can be used individually and can be stacked on top of one another in the vertical direction and releasably coupled in pairs using the coupling means to form a stacked composite preventing a mutual lift-off in the vertical direction.

3. A container assembly according to claim 1, wherein the at least one container has a longitudinal axis, which is perpendicular to the vertical direction, wherein the auxiliary accommodating bodies are arranged adjacent to one another at right angles to the longitudinal axis and are moved away from one another or towards one another in a direction perpendicular to the longitudinal axis in the transition between the home position and the access position.

4. A container assembly according to claim 1, wherein the bearing means are configured as pivot bearing means in such a way that the transitional movement is at least partially a pivoting movement in which the respective auxiliary accommodating body is pivoted while maintaining its spatial orientation relative to the main accommodating body.

5. A container assembly according to claim 4, wherein the pivot bearing means are designed such that each auxiliary accommodating body traverses an arc-shaped path curve in its transitional movement in such a way that it changes its vertical position adopted relative to the main accommodating body during the transitional movement.

6. A container assembly according to claim 1, wherein the pivot bearing means are implemented by means of a plurality of articulated parallelograms.

7. A container assembly according to claim 6, wherein each of the plurality of articulated parallelograms comprises guide arms, wherein the guide arms of the articulated parallelograms project into bearing chambers of the main accommodating body and of the auxiliary accommodating body which are formed by double-walled sections of the side walls, in such a way that they are covered towards the outside in the home position of the associated auxiliary accommodating body and in addition are bulkheaded towards the inside both from the main accommodating chamber and from the associated auxiliary accommodating chamber.

8. A container assembly according to claim 1, wherein the at least one container has a longitudinal axis perpendicular to its vertical direction, and wherein the transitional movement of the auxiliary accommodating bodies, if viewed in the vertical direction of the container, is oriented in the axial direction of a transverse axis of the container, which is perpendicular to the longitudinal axis, the coupling means being located in the region of opposite axial end faces of the base unit, which are oriented in the axial direction of the longitudinal axis.

9. A container assembly according to claim 8, wherein each of the coupling means comprises, in the region of the two axial end faces of the base unit, at least one coupling unit consisting of a lower coupling element located near the bottom of the main accommodating body and an upper coupling element located at a higher level, wherein at least one of these coupling elements is movable for optionally establishing or releasing a coupling engagement between two containers sitting on top of one another, wherein the coupling units are designed such that, in the stacked state of two containers, an upper coupling element of the bottom container can be releasably coupled to a lower coupling element of the top container.

10. A container assembly according to claim 9, wherein one coupling unit is provided on each axial end face of the base unit in the middle of its width, and/or in that the upper coupling element is a coupling element which is movable relative to the main accommodating body, while the lower coupling element is stationary on the base unit.

11. A container assembly according to claim 9, wherein the movable coupling element is a coupling tab pivotably mounted on the base unit, the other coupling element being at least one coupling projection which can be encompassed by the coupling tab.

12. A container assembly according to claim 9, wherein the upper coupling elements are placed at the level of the auxiliary accommodating bodies adopting the home position.

13. A container assembly according to claim 9, wherein the upper coupling elements are located on support columns of the base unit, which project upwards beyond the side wall of the main accommodating body.

14. A container assembly according to claim 9, wherein the at least one container is provided with locking means, which are located partly on the base unit and partly on the closing covers and which allow the closing covers to be releasably locked when the auxiliary accommodating bodies are in their home position.

15. A container assembly according to claim 14, wherein the locking means are at least partially designed as an assembly with the coupling means in such a way that, when containers stacked on top of one another are coupled, the closing covers are locked in the closing position at the same time.

16. A container assembly according to claim 14, wherein the coupling means and the locking means comprise at least one common combined coupling and locking element, which is movable relative to the base unit and which can be positioned in an active position locking the closed closing covers or in an inactive position unlocking the closing covers, wherein the combined coupling and locking element is, if adopting its active position when a further container is placed on the container to form a stacked composite, in coupling engagement with this further container as well, and wherein the coupling engagement with the further container is cancelled in the inactive position of the combined coupling and locking element.

17. A container assembly according to claim 16, wherein the coupling means comprise, in the region of each of the two axial end faces of the base unit, at least one coupling unit consisting of a lower coupling element located near the bottom of the main accommodating body and an upper coupling element located at a vertical distance therefrom at a higher level on the base unit, a combined coupling and locking element being represented by the movable upper coupling element of each of the coupling units.

18. A container assembly according to claim 1, wherein the carrying handle, starting from the main accommodating body, projects upwards between the two auxiliary accommodating bodies and is flanked on opposite sides by the two auxiliary accommodating bodies, wherein the carrying handle projects upwards above the auxiliary accommodating bodies in the home position of the two auxiliary accommodating bodies, and wherein the main accommodating body further has a slot-shaped cavity open towards its underside, into which cavity the carrying handle of a further container placed below the container can dip in the stacked state of two containers.

19. A container assembly according to claim 1, wherein there is a gap between the auxiliary accommodating bodies adopting the home position, through which gap the carrying handle extends upwards from the main accommodating body, the carrying handle projecting upwards beyond the auxiliary accommodating bodies.

20. A container assembly according to claim 1, wherein each closing cover is pivotably mounted relative to the associated auxiliary accommodating body in order to be movable between its closing position and its release position.

21. A container assembly according to claim 5, wherein each auxiliary accommodating body adopts, in the access position, the same vertical position relative to the main accommodating body as in the home position.

22. A container assembly according to claim 6, wherein each of the articulated parallelograms comprises two guide arms hinged at the auxiliary accommodating body on the one hand and at the main accommodating body on the other hand, the pivot points lying in the corner points of a parallelogram.

23. A container assembly according to claim 13, wherein the support columns extend upwards between the auxiliary accommodating bodies in the home position of the auxiliary accommodating bodies.

24. A container assembly according to claim 14, wherein the locking means are designed for the simultaneous locking and unlocking of both closing covers.

* * * * *